United States Patent [19]

Lapsker

[11] Patent Number: 4,583,328

[45] Date of Patent: Apr. 22, 1986

[54] APPARATUS FOR HIGH TOLERANCE POLISHING OF A WORKPIECE SURFACE

[75] Inventor: Itzchak Lapsker, Givatayim, Israel

[73] Assignee: GAL International Industries Inc., Forest Hills, N.Y.

[21] Appl. No.: 386,673

[22] Filed: Jun. 9, 1982

Related U.S. Application Data

[63] Continuation-in-part of Ser. No. 114,297, Jan. 22, 1980, Pat. No. 4,361,987, which is a continuation-in-part of Ser. No. 832,623, Sep. 12, 1977, abandoned.

[30] Foreign Application Priority Data

Oct. 29, 1976 [IL] Israel ..... 50794

[51] Int. Cl.[4] ..... B24B 5/00

[52] U.S. Cl. ..... 51/251; 51/330; 125/11 CD

[58] Field of Search ..... 51/90, 364, 330, 401, 51/358, 251, 254; 407/7, 61; 125/5, 37, 11 CD

[56] References Cited

U.S. PATENT DOCUMENTS

| | | | |
|---|---|---|---|
| 261,873 | 8/1882 | Prinze . | |
| 272,791 | 2/1883 | Steitz . | |
| 1,011,991 | 12/1911 | Moser | 51/90 |
| 1,210,358 | 12/1916 | Pfaustiehl . | |
| 1,429,316 | 9/1922 | Bagi | 51/262 A |
| 1,443,504 | 1/1923 | Roberts | 125/37 |
| 1,498,224 | 6/1924 | Atwood | 125/5 |
| 1,519,876 | 12/1924 | Phelps | 407/61 |
| 1,590,190 | 6/1926 | Heim . | |
| 2,023,572 | 12/1935 | Brendel | 51/90 |
| 2,024,591 | 12/1935 | Manchester | 51/401 |
| 2,054,311 | 9/1936 | Adams | 407/7 |
| 2,259,685 | 10/1941 | Eslsloo | 51/364 |
| 2,460,367 | 1/1949 | Sharpe | 51/206 R |
| 2,546,490 | 3/1951 | Baldwin | 51/90 X |
| 2,649,648 | 8/1953 | Pinto | 407/61 |
| 2,770,926 | 11/1956 | Holmland . | |
| 2,885,766 | 5/1959 | Ernst | 407/7 |
| 3,263,668 | 8/1966 | Strauss | 125/37 |
| 3,329,065 | 7/1967 | Vaughn | 407/7 |
| 3,955,327 | 5/1976 | Franco | 51/206 P |
| 3,971,358 | 7/1976 | Sawluk | 125/11 CD |

FOREIGN PATENT DOCUMENTS

| | | | |
|---|---|---|---|
| 298917 | of 0000 | Canada . | |
| 266768 | of 0000 | Fed. Rep. of Germany . | |
| 450767 | of 0000 | Fed. Rep. of Germany . | |
| 414722 | of 0000 | Sweden . | |
| 956762 | of 0000 | United Kingdom . | |
| 821742 | of 0000 | United Kingdom . | |
| 478180 | of 0000 | United Kingdom . | |
| 397160 | of 0000 | United Kingdom . | |
| 282407 | of 0000 | United Kingdom . | |
| 1466545 | of 0000 | United Kingdom . | |
| 1461570 | of 0000 | United Kingdom . | |
| 1410290 | of 0000 | United Kingdom . | |
| 1345350 | of 0000 | United Kingdom . | |
| 1098047 | of 0000 | United Kingdom . | |
| 497412 | 3/1937 | United Kingdom | 51/90 |
| 261873 | of 0000 | U.S.S.R. . | |
| 272791 | of 0000 | U.S.S.R. . | |

OTHER PUBLICATIONS

"Progressive Methods of Rotating Cutting of Metals", Minsk, 1971, USSR.

*Primary Examiner*—Harold D. Whitehead
*Attorney, Agent, or Firm*—Browdy and Neimark

[57] ABSTRACT

Apparatus for finishing a workpiece comprising a resilient abrasive finishing element arranged for motion relative to a workpiece surface and in pressure engagement therewith. Methods of finishing a workpiece employing this apparatus are also disclosed. Both grinding and high surface quality polishing may thus be provided using the same machine tool, such as a lathe or milling machine, and appropriate finishing elements.

6 Claims, 12 Drawing Figures

APPARATUS FOR HIGH TOLERANCE POLISHING OF A WORKPIECE SURFACE

This is a continuation-in-part of U.S. patent application Ser. No. 114,297 filed Jan. 22, 1980 and now U.S. Pat. No. 4,361,987 issued Dec. 7, 1982, which is a continuation-in-part of application Ser. No. 832,623, filed Sept. 12, 1977 and now abandoned.

The present invention relates to surface finishing apparatus which provides grinding and polishing functions.

Conventional techniques for precision machining of metal surfaces require that a workpiece be subjected to a conventional machining operation in a first machine and then be transferred to a second machine for a precision grinding and polishing operation. The required use of at least two processing machines involving the transfer of the workpiece from one to the other adds significantly to the time and cost involved in precision surface finishing and limits the quality which can be achieved. It is therefore desired to provide apparatus which is capable of producing a precision finished surface while requiring the use of only a single machine tool having replaceable finishing elements.

The present invention provides apparatus for finishing a workpiece comprising a resilient abrasive finishing element arranged for motion relative to a workpiece surface and in pressure engagement therewith.

There is also provided in accordance with an embodiment of the invention a method for finishing a workpiece comprising the steps of providing a finishing element including a volume of abrasive-containing resilient material and causing the finishing element to move relatively to a workpiece surface under pressure.

It is a particular feature of the present invention that the resilient nature of the finishing element provides area rather than line contact between the finishing element and the workpiece surface during finishing operations under pressure.

The invention will be more fully understood and appreciated from the following detailed description taken in conjunction with the drawing in which.

Figure 7:
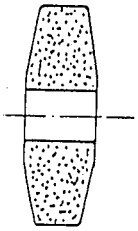
Figure 8:
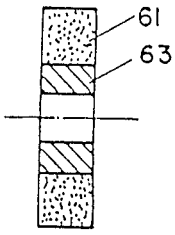
Figure 9:
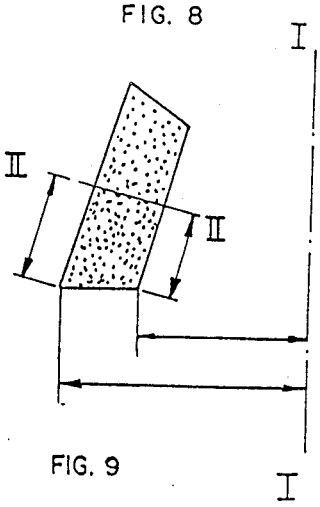
Figure 10A:
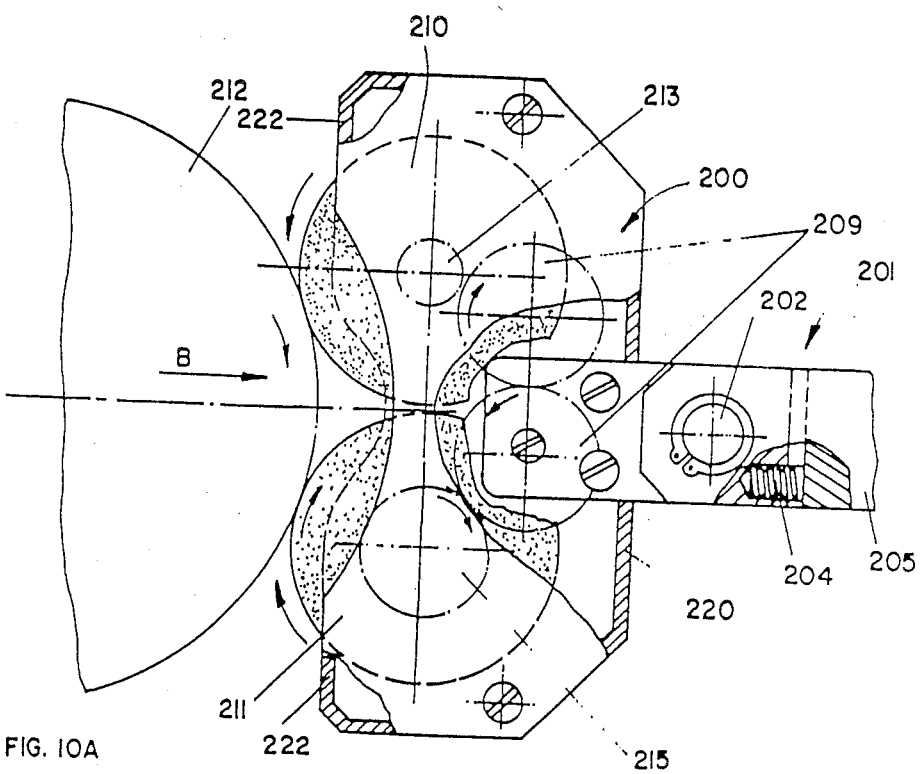
Figure 10B:
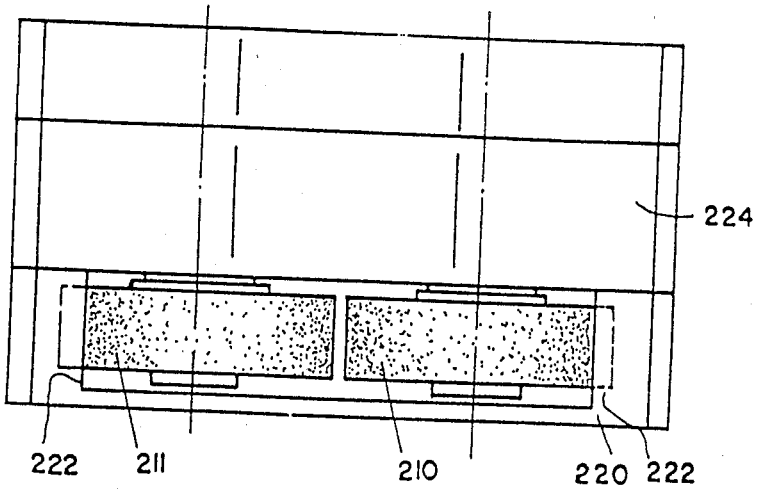

FIGS. 7, 8 and 9 each illustrate an embodiment of a finishing element;

FIG. 10A is a sectional side view illustration of a finishing device useful with a lathe or other turning machine;

FIG. 10B is a plan view of the device of FIG. 10A taken in a direction indicated by an arrow B.

The present invention provides finishing apparatus which may be employed selectably for grinding and polishing by suitable selection of the characteristics of the resilient abrasive finishing element. When used for polishing or grinding, sufficient pressure is provided such that the finishing element is compressed by approximately 30–300 microns thereby producing an area rather than line contact between the finishing element and the workpiece surface. Such a polishing technique provides a reduction of approximately 0.0005 mm and provides an extremely high quality surface finish of the order of between 16 and 2 microinch r.m.s., and preferably up to 4–2 microinch r.m.s. Such a grinding technique provides a reduction of approximately 5–50 microns.

It is appreciated that the finishing element in one embodiment of the invention undergoes a complex motion with respect to the workpiece which greatly adds to the quality of the surface finish. This complex motion comprises the rotation of the housing or base onto which the finishing element is mounted, the rotation of each finishing element about its own axis and the motion of the workpiece on a moveable table relative to the polishing element. According to a preferred embodiment of the invention, the finishing technique includes rotation of the base or housing in opposite directions which may correspond to opposite directions of the workpiece movement on the moving table.

Figure 1:
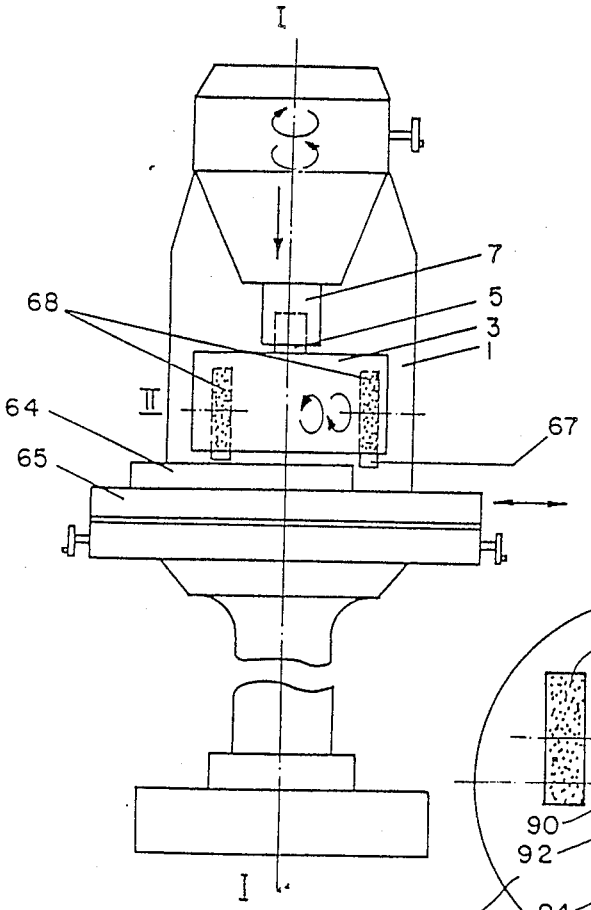
FIG. 1 is a pictorial illustration of finishing apparatus associated with a workpiece and mounted onto a rotary milling machine of conventional construction.

Reference is now made to FIG. 1 which illustrates finishing apparatus constructed in accordance with an embodiment of the present invention in operative association with a conventional milling machine for rotational engagement under pressure with a workpiece. The finishing apparatus is indicated generally by reference numeral 1 and comprises a body portion 3 and a shank portion 5 which is insertable into the chuck of the milling machine 7 for rotation selectably in opposite directions about the spindle axis I—I of the milling machine. The workpiece, 64, is preferably mounted on a movable table 65 associated with the milling machine. Normally the finishing apparatus is rotated initially in a first direction while the movable table moves in a first longitudinal direction. Thereafter, as the table returns in an opposite direction, the rotation of the finishing apparatus may be in an opposite direction. This two direction capability provides evenly, randomly directly finishing marks.

The pressure engagement of the finishing apparatus with the workpiece surface is illustrated in FIG. 1 by the extent 67 to which the finishing element indicated by reference numeral 68 is compressed when it engaged the workpiece surface. As noted above, this compression is approximately 30–300 microns. Preferably the pressure is exerted perpendicular to the workpiece surface.

Figure 2:
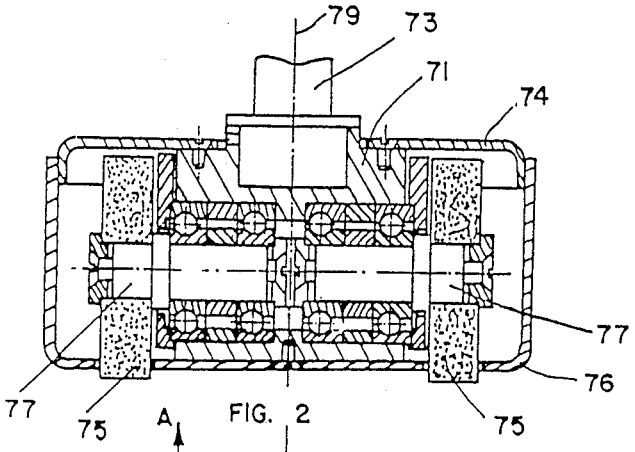
FIG. 2 is a side view illustration of a finishing device constructed and operative in accordance with an embodiment of the invention.
Figure 3:
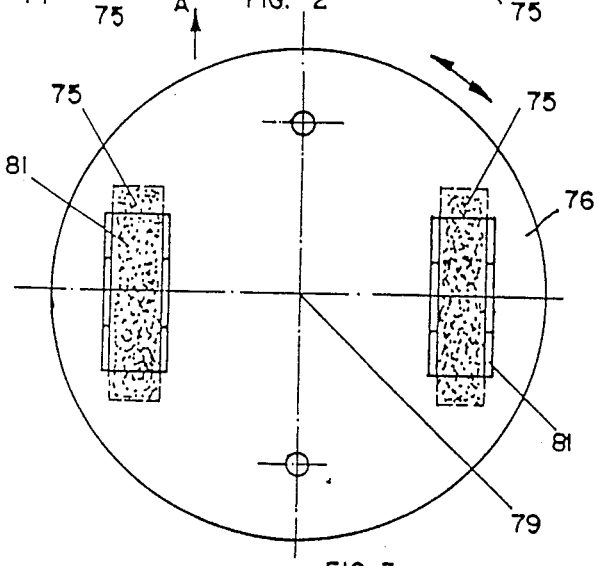
FIG. 3 is a bottom view of the finishing device of FIG. 2.

Reference is now made to FIGS. 2 and 3 which illustrate the finishing apparatus of the present invention in greater detail. The apparatus comprises a housing base 71 which is fixedly attached to a shank 73 and supports a housing top portion 74 and bottom portion 76. Disposed mainly within the housing are a pair of finishing elements 75, typically in the form of annular disks. Elements 75 are mounted rigidly onto respective axles 77 which in turn are bearing mounted within the housing for relatively free rotation with respect thereto. The axes of rotation of both finishing elements 75 are identical and intersect with the axis of rotation of the housing indicated by reference numeral 79, as seen in FIG. 3.

It is a particular feature of the present invention that housing top and bottom portions 74 and 76 together define means for collecting particulate matter which is produced as the result of the wearing down of the resilient finishing elements.

As seen in FIG. 3, the finishing elements 75 are disposed mainly above the bottom surface of bottom housing portion 76 and only a portion thereof extends outside of the housing, through openings 81 formed in the bottom surface. Openings 81 are constructed to be of as small an area as possible and therefore have a width only slightly greater than that of the finishing elements, sufficient to prevent interference with the free rotation thereof. The length of the openings is less than the diameter of the finishing elements. Thus particulate matter generated in a finishing operation from wear of the finishing element is gathered into the interior of the housing bottom portion 76 so as not to interfere with the finishing and not to provide uneven results and cause damage to the apparatus.

Figure 4B:
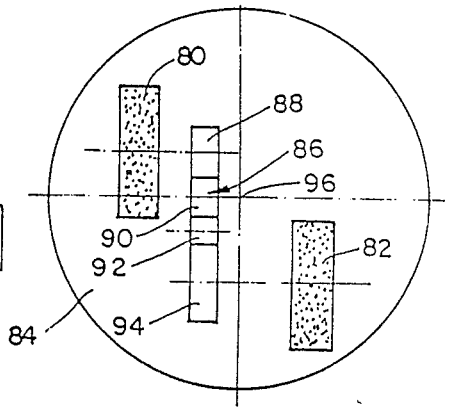
FIG. 4B is a schematic illustration of a further alternative embodiment of a finishing device.
Figure 4A:
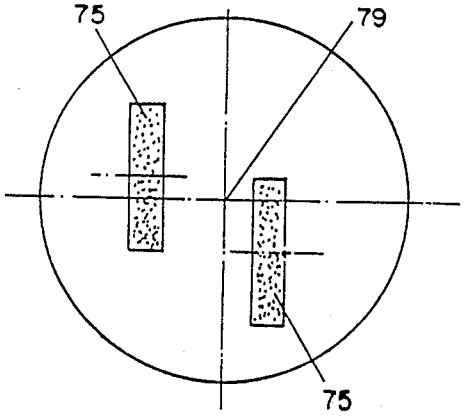
FIG. 4A is a bottom view illustration of an alternative embodiment of a finishing device.

According to a preferred embodiment of the invention, illustrated schematically in FIG. 4A, the axes of rotation of the finishing elements 75 are offset from each other and do not intersect axis 79. This non-intersection feature provides an additional vector moment of motion between the finishing element and the workpiece surface when housing base 71 is driven in rotary pressurized motion relative to the workpiece surface.

FIG. 4B illustrates finishing apparatus constructed and operative in accordance with a variation of the embodiment of FIG. 4A. Here finishing elements 80 and 82 are not mounted for independent free rotation relative to the housing 84, as in FIG. 4A but rather are interconnected by a transmission 86, typically comprising an odd or even number of gears. An even number of gears comprising gears 88, 90, 92 and 94, for example, is preferred since it provides rotation of elements 80 and 82 in respective opposite directions for enhanced finishing action. It is noted that finishing elements 80 and 82 are offset by different amounts from the rotation axis 96 of the housing, thus producing different speeds of rotation in the finishing elements, were the elements not connected by a fixed transmission. It is appreciated that the transmission may be constructed such that a non-unitary fixed ratio of speeds is maintained between the two finishing elements. The two finishing elements may be constructed to be of different widths and to have differing abrasive characteristics.

Figure 5:
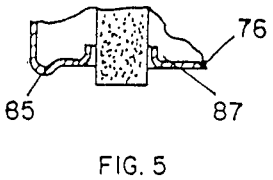
FIG. 5 is a detailed illustration of a portion of a finishing device.

FIG. 5 illustrates a preferred construction of a portion of the bottom housing portion 76 wherein a recess 85 is defined at the inner periphery of the portion 76 for collection of particulate matter along the outermost portions of the interior of the housing under the influence of centrifugal forces produced by the high speed rotation of the housing during operation. Portions 87 of the housing bottom surface adjacent the finishing elements are bent upwardly to define a barrier for preventing, insofar as possible, particulate matter from escaping from the housing. The bottom portion 76 is constructed to be removable for easy cleaning.

Figure 6:
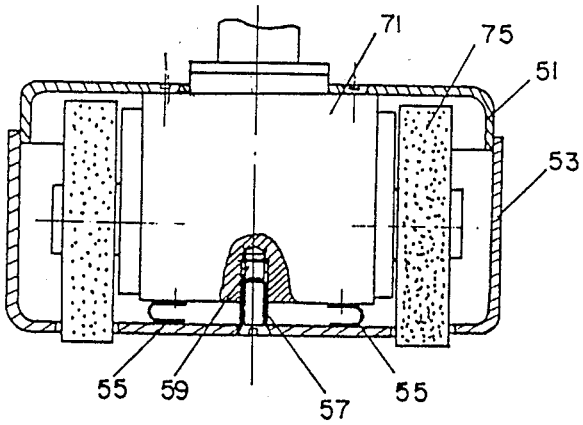
FIG. 6 is a partially cut away illustration of a finishing device.

A further development of the apparatus of FIG. 5 is illustrated in FIG. 6 and comprises a housing wherein the bottom portion 53 thereof is selectably positionable relative to finishing elements 75 in order to compensate for wear therein, and the resulting significant decrease in their diameter. Bottom portion 53 is spring mounted onto the housing base 71 by means of a pair of bent leaf springs 55 and is secured to the housing base by means of a screw fastener 57. The extent to which the screw fastener 57 is inserted into a corresponding socket 59 formed in the housing base 71 determines the relative disposition of the bottom surface of the bottom portion 53.

FIGS. 7, 8 and 9 illustrate different embodiments of finishing elements constructed and operative in accordance with an embodiment of the present invention. The element of FIG. 7 is of generally annular configuration having a truncated conical cross section of increasing width with decreasing radius and is formed of a resilient material, typically rubber based, having abrasive material, typically in the form of grains, dispersed therein throughout the usable volume thereof. The configuration of FIG. 7 is designed to maintain the operating characteristics of the element generally constant notwithstanding wearing down and consequent reduction of the diameter of the element during use. Thus, as the element is worn down, the same effective width and pressure is applied to the workpiece surface.

FIG. 8 shows an alternative form of finishing element comprising an outer annular ring 61 of generally uniform resilient abrasive material of the type described in connection with FIG. 7, preferably with a resiliency greater than 75 of the Shore scale. The inner core 63 may be constructed of natural rubber, for example, for use in polishing applications. For use in grinding applications, however, the inner core 63 should be formed of metal or hard plastic or similar material to provide precision mounting of the element on a mounting shaft, for accurate grinding. It is appreciated that when the finishing elements of the type described herein are used for grinding, the resiliency will be less than in polishing applications and the abrasive will be substantially rougher.

FIG. 9 illustrates the use of a conically shaped finishing element of generally uniform resilient abrasive composition. In the illustrated embodiment, the element is arranged such that its radius about its axis II—II of rotation increases with an increasing distance from the axis I—I of rotation of the housing. Thus the element is particularly suited for finishing of interior corners. Alternatively the finishing element of FIG. 9 may be oriented oppositely such that its radius about its axis II—II of rotation increases with an increasing distance from axis I—I. Thus the absolute value of the velocity of rotation at all points along the element is generally the same.

According to an alternative embodiment of the invention, the finishing elements may comprise a relatively soft resilient elastic base formed with an abrasive outer surface. The base may be a resinoid, rubber or a porous polyurethane. The abrasive may comprise grains of diamond, borozone or silicone carbide, for example.

Reference is now made to FIGS. 10A and 10B which show a finishing device constructed and operative in accordance with an embodiment of the present invention and comprising a base 200 on which are mounted at least two finishing elements 210 and 211. Elements 210 and 211 are arranged so as to simultaneously contact a rotating workpiece 212 mounted for rotation on a conventional lathe such as a metal lathe. Base 200 is in turn rotatably mounted by means of mounting means 201 comprising a pin and sprocket 202 and a biasing spring 204 or similar suitable apparatus onto a tool holder 205 which may be inserted into a conventional tool holding clamp on the lathe. Biasing spring 204 is operative to maintain the finishing elements in operative engagement with the workpiece surface.

Elements 201 and 211 are interconnected by a transmission typically comprising a pair of gears 209 which engage corresponding gears 213 and 215, having different numbers of teeth, which gears are mounted onto elements 210 and 211 respectively. This arrangement insures that elements 210 and 211 move in respective opposite directions at different speeds against the workpiece, thus providing enhanced finishing action. Preferably the faster one of the finishing elements moves together with the workpiece in a generally non-slipping engagement, while the other moves against the workpiece surface. Alternatively elements 210 and 211 may be caused to move in the same direction at different speeds.

It is noted that the embodiment of FIG. 4B, for example, may be constructed with a similar transmission.

It is noted that finishing elements 210 and 211 are generally surrounded by a housing 220 which defines a collector for particulate matter produced by wearing down of the finishing elements. Housing 220 is designed to retain as much as possible of such particulate matter which is propelled inwardly thereto by the adjacent inward rotation of the finishing elements 210 and 211. Bottom and top edges 222 are disposed adjacent the finishing elements to discourage escape of the particulate matter.

Referring particularly to FIG. 10B it is noted that the finishing elements 210 and 211 are located at one side of the apparatus at collector housing 220. Adjacent thereto in the middle of the apparatus indicated by reference numeral 224, there are provided the mounting bearings for the finishing elements. At location 226, entirely sealed from the outside for safety, are provided the gears 209, 213 and 215.

It is a particular feature of the present invention that the gear ratio of the transmission is selected such that the ratio of the surface speeds of finishing elements 210 to element 211 is at least 1.1.

It is noted that enhanced surface quality may be realized by moving the finishing apparatus transversely along the workpiece in opposite directions.

It is appreciated that the apparatus of FIGS. 10A and 10B may be used also for finishing the flat end face of a surface of rotation mounted on a lathe by arranging the housing such that elements 210 lie against the flat face. A high quality finish on the surface of rotation may be realized by back and forth movement of the tool axially along the workpiece. This is equivalent to operation of a milling machine in opposite directions in the embodiment of FIG. 1.

It will be appreciated by persons skilled in the art that the invention is not limited to what has been specifically shown and described herein. Rather, the scope fo the present invention is defined only by the claims which follow:

I claim:

1. Apparatus for effecting high tolerance finishing of a workpiece surface comprising:

a mounting member including attachment means suitable for attachment to rotary drive apparatus for rotation of the mounting member;

a plurality of resilient abrasive finishing elements each of which is rotatably mounted on said mounting member for motion relative to said workpiece surface in a plane substantially perpendicular to the plane of rotation of said mounting member; and transmission means coupled between said finishing elements for causing said finishing elements to move at different surface speeds with respect to each other in a predetermined relationship; and wherein the resilient and abrasive substances of said finishing elements are selected in order to provide in said workpiece a surface finish of 2–4 microinch rms.

2. Apparatus according to claim 1 and wherein said plurality of finishing elements comprise at least two elements which move in opposite directions.

3. Apparatus according to claim 1 and wherein said mounting member also comprises means for collecting particulate matter resulting from wear of said finishing elements.

4. Apparatus according to claim 1 and wherein said mounting member also comprises a biasing spring for maintaining said plurality of finishing elements in operative engagement with a workpiece surface.

5. Apparatus according to claim 1 and wherein each of the said finishing elements comprises an annular body formed of resilient material and having abrasive material dispersed therein throughout the usable volume thereof.

6. Apparatus according to claim 1 and wherein the axes of rotation of the said finishing elements are not colinear.

* * * * *

UNITED STATES PATENT AND TRADEMARK OFFICE

CERTIFICATE OF CORRECTION

PATENT NO. : 4,583,328

DATED : April 22, 1986

INVENTOR(S) : Itzchak LAPSKER

It is certified that error appears in the above-identified patent and that said Letters Patent is hereby corrected as shown below:

[73] Assignee: G.B.I. International Industries, Inc., New Hyde Park, N.Y.

Signed and Sealed this

Eighteenth Day of November, 1986

*Attest:*

DONALD J. QUIGG

*Attesting Officer* *Commissioner of Patents and Trademarks*